US009719285B2

(12) United States Patent
Nagl et al.

(10) Patent No.: US 9,719,285 B2
(45) Date of Patent: Aug. 1, 2017

(54) DAMPING HINGE FOR DAMPING A HINGE ROTATIONAL MOVEMENT ABOUT A HINGE ROTATIONAL AXIS

(71) Applicant: SUSPA GmbH, Altdorf (DE)

(72) Inventors: Wolfgang Nagl, Allersberg (DE); Herbert Wolf, Altdorf (DE)

(73) Assignee: SUSPA GmbH, Altdorf (DE)

( * ) Notice: Subject to any disclaimer, the term of this patent is extended or adjusted under 35 U.S.C. 154(b) by 0 days.

(21) Appl. No.: 14/820,952

(22) Filed: Aug. 7, 2015

(65) Prior Publication Data

US 2016/0040468 A1 Feb. 11, 2016

(30) Foreign Application Priority Data

Aug. 11, 2014 (DE) ..... 10 2014 215 902

(51) Int. Cl.
*E05F 3/20* (2006.01)
*E05F 5/10* (2006.01)
(Continued)

(52) U.S. Cl.
CPC ..... *E05F 5/10* (2013.01); *E05D 3/02* (2013.01); *E05F 3/20* (2013.01); *E05F 5/02* (2013.01); *E05Y 2201/604* (2013.01); *E05Y 2201/696* (2013.01); *E05Y 2600/12* (2013.01); *E05Y 2600/32* (2013.01); *E05Y 2600/33* (2013.01)

(58) Field of Classification Search
CPC ..... E05Y 2201/20; E05Y 2201/21; E05Y 2201/212; E05Y 2201/214; E05Y 2201/216; E05Y 2201/25; E05Y 2201/256; E05Y 2201/236; E05F 3/00; E05F 3/04; E05F 3/20; E05F 5/02; E05F 5/027; E05F 5/10; E05F 1/1207; E05F 1/1215;
(Continued)

(56) References Cited

U.S. PATENT DOCUMENTS 2,484,764 A * 10/1949 Swanson ..... E05F 3/20 16/54
2,490,258 A * 12/1949 Diebel ..... E05F 3/20 16/54
(Continued)

FOREIGN PATENT DOCUMENTS

DE 829 413 C 1/1952
DE 10 2004 043 899 A1 3/2006
(Continued)

OTHER PUBLICATIONS

European Search Report of Dec. 16, 2015.

*Primary Examiner* — Chuck Mah
(74) *Attorney, Agent, or Firm* — McGlew and Tuttle, P.C.

(57) ABSTRACT

A damping hinge for damping a hinge rotational movement about a hinge rotational axis comprises a housing extending along the hinge rotational axis, the housing comprising a first housing part, a second hosing part, which is rotatable relative to the first housing part about the hinge rotational axis, and a piston arranged in the working chamber such as to be displaceable along the hinge rotational axis, a piston rod for displacing the piston, and an adjustment device for adjusting a damping effect of the damping hinge, the adjustment device having a plurality of discrete adjustment stages each providing a different damping effect.

17 Claims, 8 Drawing Sheets

(51) Int. Cl.
*E05D 3/02* (2006.01)
*E05F 5/02* (2006.01)

(58) Field of Classification Search
CPC .. E05F 1/1223; E05F 1/1008; Y10T 16/2771; Y10T 16/304
See application file for complete search history.

(56) References Cited

U.S. PATENT DOCUMENTS 4,155,144 A * 5/1979 Koganei ..... E05F 3/20 16/54
4,829,628 A * 5/1989 Vuksic ..... E05F 3/20 16/299
5,152,029 A * 10/1992 Pai ..... E05D 5/10 16/54
5,572,768 A * 11/1996 Daul ..... E05F 1/1215 16/337
6,205,619 B1 * 3/2001 Jang ..... E05D 5/10 16/352
6,658,694 B2 * 12/2003 Wang ..... E05F 1/1223 16/284
6,854,161 B2 * 2/2005 Lee ..... E05F 1/1223 16/50
6,928,699 B2 * 8/2005 Sawa ..... E05F 3/20 16/303
7,966,693 B2 * 6/2011 Choi ..... E05F 3/20 16/284
8,752,244 B2 * 6/2014 Talpe ..... E05F 3/14 16/54
2009/0265889 A1 10/2009 Pan
2011/0072618 A1 * 3/2011 Chen ..... E05F 1/1215 16/303
2014/0137478 A1 5/2014 Nagl et al.
2015/0233164 A1 * 8/2015 Bacchetti ..... E05F 3/20 16/54

FOREIGN PATENT DOCUMENTS

WO 2006 027275 A1 3/2006
WO 2012/139957 A1 10/2012

* cited by examiner

DAMPING HINGE FOR DAMPING A HINGE ROTATIONAL MOVEMENT ABOUT A HINGE ROTATIONAL AXIS

CROSS-REFERENCE TO RELATED APPLICATIONS

This application claims the priority of German Patent Application, Serial No. 10 2014 215 902.4, filed on Aug. 11, 2014, pursuant to 35 U.S.C. 119(a)-(d), the content of which is incorporated herein by reference in its entirety as if fully set forth herein.

FIELD OF THE INVENTION

The invention relates to a damping hinge for damping a hinge rotational movement about a hinge rotational axis.

BACKGROUND OF THE INVENTION

A damping hinge is known from WO 2012/139957 A1. A damping characteristic of the damping hinge is infinitely variable.

SUMMARY OF THE INVENTION

The invention is based on the object of improving a damping hinge and in particular the handling thereof in such a way that the damping behavior is easily adjustable.

This object is achieved by a damping hinge for damping a hinge rotational movement about a hinge rotational axis, comprising a housing extending along the hinge rotational axis, comprising a first housing part, a second housing part, which is rotatable about the hinge rotational axis in relation to the first housing part, a working chamber arranged in the housing, a piston arranged in the working chamber such as to be displaceable along the hinge rotational axis, a piston rod for displacing the piston, and an adjustment device for adjusting a damping effect of the damping hinge, the adjustment device having a plurality of discrete adjustment stages each providing a different damping effect. The gist of the invention is that an adjustment device is provided for adjusting a damping effect of a damping hinge. The adjustment device has a plurality of discrete adjustment stages. Each adjustment stage represents a different damping effect. The damping hinge according to the invention allows a particular damping effect to be set more easily. In particular, it is possible, even for a lay person, to reset the damping effect back to the original state once set. The damping hinge is user-friendly. The purpose of the damping hinge is to damp a hinge rotational movement about a hinge rotational axis. The damping hinge comprises a housing extending along the hinge rotational axis, the housing comprising a first housing part, a second housing part, which is rotatable in relation to the first housing part about the hinge rotational axis, and a working chamber arranged in the housing. The working chamber is in particular sealed in the housing. The damping hinge further comprises a piston arranged in the working chamber in a sealed manner, the piston being displaceable along the hinge rotational axis, and a piston rod for displacing the piston. In particular, the piston divides the working chamber into a first partial working chamber and a second partial working chamber. The piston in particular comprises a throttling channel, which produces an in particular throttled fluid communication between the first partial working chamber and the second partial working chamber.

A damping hinge in which the adjustment device has an adjustment unit for directly influencing the damping effect allows for easier handling and allows the damping effect to be adjusted directly.

A damping hinge in which the adjustment unit comprises a first adjustment element and a second adjustment element allows the damping effect to be adjusted easily by an interaction of the first adjustment element with the second adjustment element. In particular, the first adjustment element and the second adjustment element are kinematically coupled to each other, in particular using a movement thread. In particular, a rotation of the first adjustment element about the hinge rotational axis causes the second adjustment element to be displaced axially along the hinge rotational axis. In particular, the first adjustment element is configured as an adjustment spindle comprising a needle. The adjustment spindle is in particular arranged in such a way as to be rotatable and axially displaceable in the housing in relation to the hinge rotational axis and in particular in relation to the piston rod. The second adjustment element is in particular configured as an adjustment sleeve. The adjustment sleeve is fixed to the piston rod. The adjustment sleeve in particular has an internal thread, which interacts with an external thread of the adjustment spindle in the manner of a movement thread.

A damping hinge in which the adjustment unit is at least partly arrangeable in a throttling channel of the piston, allows the damping effect to be influenced directly. The damping effect is in particular characterized by a cross-sectional area of the throttling channel perpendicular to the hinge rotational axis and a flow path along the hinge rotational axis having this cross-sectional area. The longer a flow path in conjunction with a reduced cross-sectional area, the greater the throttling effect, in other words the damping effect. This means that the deeper the first adjustment element is arranged in the throttling channel, the higher the damping effect.

A damping hinge comprising an actuation unit allows the adjustment unit to be actuated directly. The accessibility and in particular the handling of the damping hinge are improved, in particular for a lay person.

A damping hinge in which the actuation unit comprises an actuation element and a coupling element facilitates the interaction between actuation unit and adjustment unit.

A damping hinge in which the actuation element and the coupling element are non-rotationally coupled to each other in relation to the hinge rotational axis allows a direct transmission of a torque from the actuation element to the coupling element.

A damping hinge in which the actuation element is rotatably arranged in the housing in relation to the hinge rotational axis allows a simple and direct actuation by applying a torque to the actuation element about the hinge rotational axis in order to adjust the damping effect.

A damping hinge in which the actuation element has a first snap-in locking element provides for a snap-locked arrangement of the actuation element. In particular, the first snap-in locking element is configured as a snap-in locking protrusion or a pin. The snap-in locking protrusion or pin extends in particular radially in relation to the hinge rotational axis. The first snap-in locking element has a contour allowing a snap-locked arrangement thereof on a counter snap-in locking element of a counter snap-in locking unit. In particular, the contour of the first snap-in locking element is at least partly convex. Correspondingly, the complementary contour of the counter snap-in locking element is concave. The first snap-in locking element allows the actuation element to be arranged in a snap-locked manner in relation to the hinge rotational axis in an angular position in relation to the hinge rotational axis. The first snap-in locking element is in particular arranged eccentrically to the hinge rotational axis. When actuating the actuation element, in other words when performing a rotational movement of the actuation element about the hinge rotational axis, the snap-in locking element performs a rotational movement on a circular path about the hinge rotational axis. In particular, the convex contour of the first snap-in locking element is guided around the hinge rotational axis on a circular path.

A damping hinge in which the coupling element has a non-round cross-section oriented perpendicularly to the hinge rotational axis ensures an uncomplicated torque transmission from the coupling element to the adjustment unit. In particular, the coupling element interacts directly with the adjustment unit and, in particular, with the first adjustment element. In particular, the coupling element and the adjustment unit are arrangeable in such a way, in particular in the region of the first adjustment element, that they are arranged concentrically in the damping hinge in relation to the hinge rotational axis, namely in the form of an assembly group having a round cross-section.

A damping hinge with a counter snap-in locking unit allows the actuation unit to be arranged in a snap-locked manner. The actuation unit can thus be arranged in a desired rotational position in relation to the hinge rotational axis, thus making it impossible to inadvertently change the rotational position of the actuation unit and, consequently, the damping effect. In particular, it is possible to reset a damping effect once set by specifically selecting a position of the actuation unit in the snap-locked arrangement.

A damping hinge in which the counter snap-in locking unit is configured in one piece ensures a simple design and, in particular, mounting of the damping hinge. The counter snap-in locking unit has a functionally integrated and compact design. In particular, the counter snap-in locking unit is made of plastics and in particular of polyoxymethylene (POM). The counter snap-in locking unit has a lightweight design. Other materials, in particular metal materials, are conceivable as well.

A damping hinge in which the counter snap-in locking unit is fastened to the housing ensures a stable coupling of the counter snap-in locking unit to the housing. In particular, the counter snap-in locking unit has at least one locking element allowing the counter snap-in locking unit to be locked with the housing. In particular, the at least one locking element is configured as a snap-in locking spring that is able to snap into a corresponding recess on the housing. In particular, the at least one locking element allows an axial locking along the hinge rotational axis.

A damping hinge in which the counter snap-in locking unit comprises a plurality of counter snap-in locking elements allows one to easily define a snap-in locking position for the actuation unit in the snap-locked position. In particular, the counter snap-in locking elements are configured to interact directly with the first snap-in locking elements of the actuation unit. The counter snap-in locking elements are in particular configured as snap-in locking grooves provided on an outer periphery of the counter snap-in locking unit. Depending on a desired adjustment range, it is conceivable to provide for instance 20 or more snap-in locking grooves. In particular, at least 25 and in particular at least 30 snap-in locking grooves are provided along the outer periphery of the counter snap-in locking unit. In particular, the snap-in locking grooves are arranged such as to be evenly spaced from each other along the outer periphery. On the other hand, it is conceivable as well to provide less than 20 snap-in locking grooves, in particular no more than 15, in particular precisely 12, in particular no more than 10, and in particular no more than 5 snap-in locking grooves. The number of snap-in locking grooves directly defines the number of adjustment stages for the damping effect of the damping hinge. The snap-in locking grooves allow the rotational position of the actuation unit to be adjusted along a 360° rotation about the hinge rotational axis. The direct interaction of the first snap-in locking element of the actuation element with one of the counter snap-in locking elements of the counter snap-in locking unit facilitates a reproducible positioning of the actuation unit to ensure a reproducible adjustment of the damping effect.

The counter snap-in locking unit may additionally be provided with at least one stop element. The stop element in particular interacts with the first snap-in locking element of the actuation element in such a way that a rotational movement of the actuation unit about the hinge rotational axis is impaired in at least one direction of rotation. In particular, the stop element and the first snap-in locking element interact in such a way that the impaired rotational movement can be overcome by applying an additional torque to the actuation unit. The additional torque required to do this may for instance be applied to the actuation unit using a tool. In particular, the actuation unit has a tool section allowing a tool to be applied thereto. When the stop element is turned over with increased torque, a user receives a direct feedback that a predefined limit of the rotational movement is reached. In particular when multiple rotations are carried out to adjust the damping effect, in other words if a rotational adjustment movement is greater than 360° in relation to the hinge rotational axis, the user receives a direct feedback with respect to the total rotational movement performed.

A damping hinge in which the counter snap-in locking unit comprises a connection element to be connected to the actuation unit allows the counter snap-in locking unit and the actuation unit to be configured as a compact assembly group. This assembly group may for instance be preassembled and mounted to the housing in a single mounting step. The connection element is in particular configured as a radially projecting protrusion, in particular a circumferential bead, to ensure that the counter-snap-in locking unit is securely mounted to the actuation unit in the axial direction. The assembly group connected in this manner may be connected to the housing by means of the at least one locking element. It is conceivable as well for the assembly group to be press-fitted into a corresponding recess of the housing, in other words it is held therein by means of a non-positive connection, in particular by friction.

Additional features, advantages and details of the invention will be apparent from the ensuring description of an exemplary embodiment, taken in conjunction with the drawing.

Figure 1:
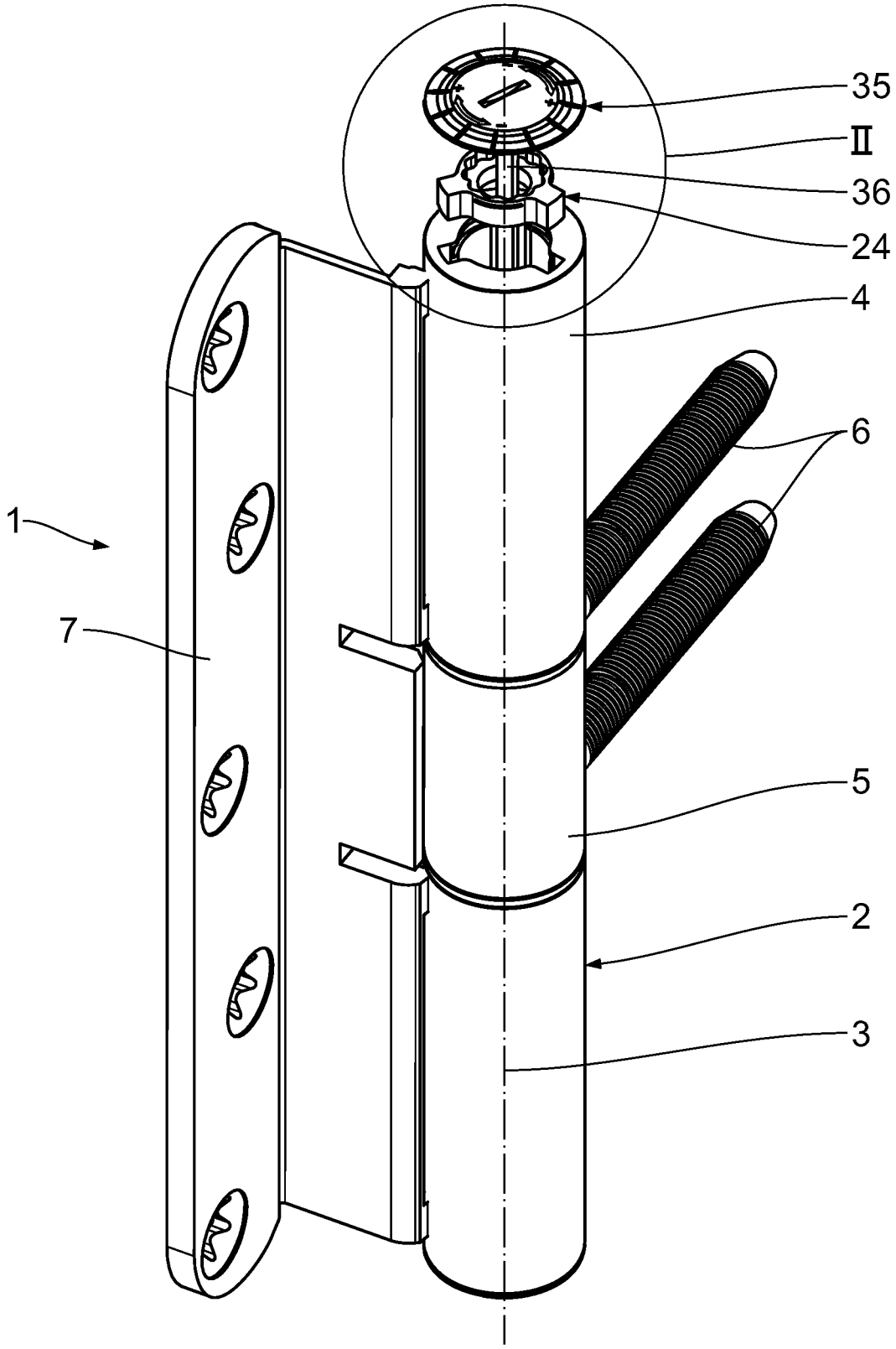
FIG. 1 shows a perspective partially exploded view of a damping hinge according to the invention.
Figure 2:
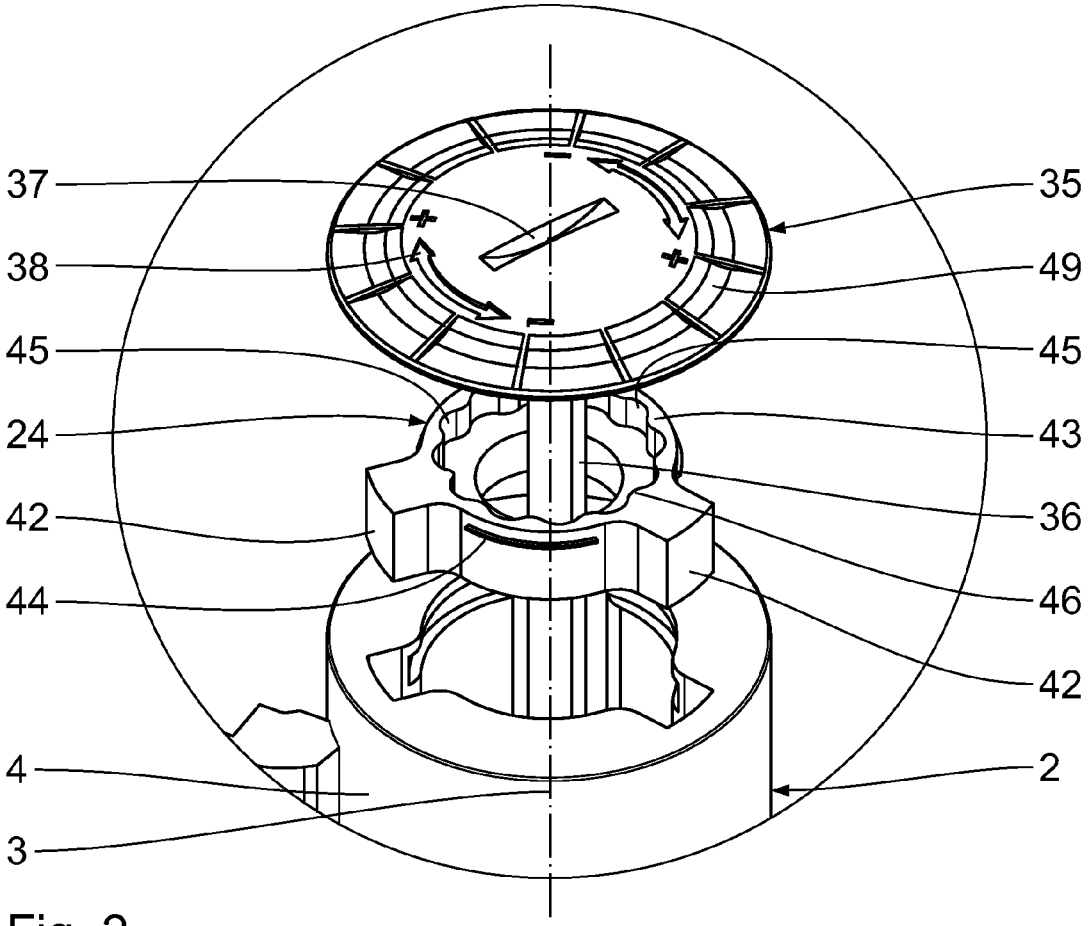
FIG. 2 shows an enlarged detail view of detail II in FIG. 1.
Figure 3:
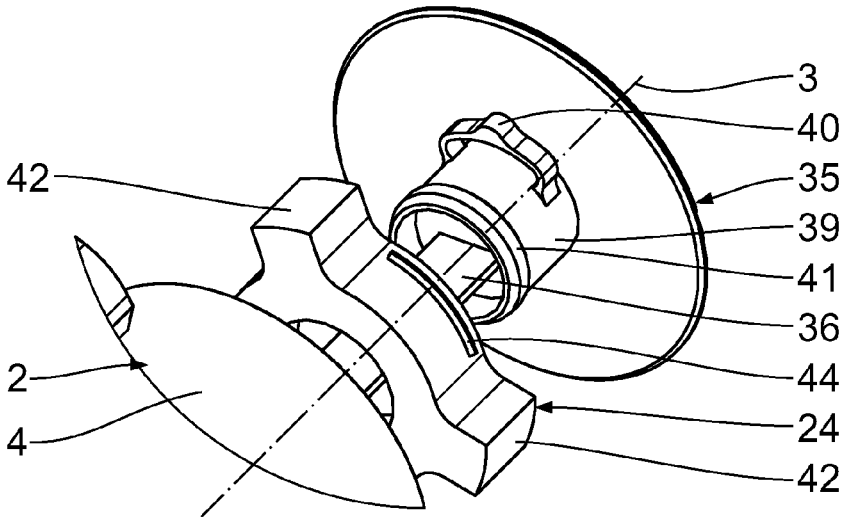
FIG. 3 shows an enlarged detail view of the damping hinge in FIG. 1 in a perspective view from below.
Figure 4:
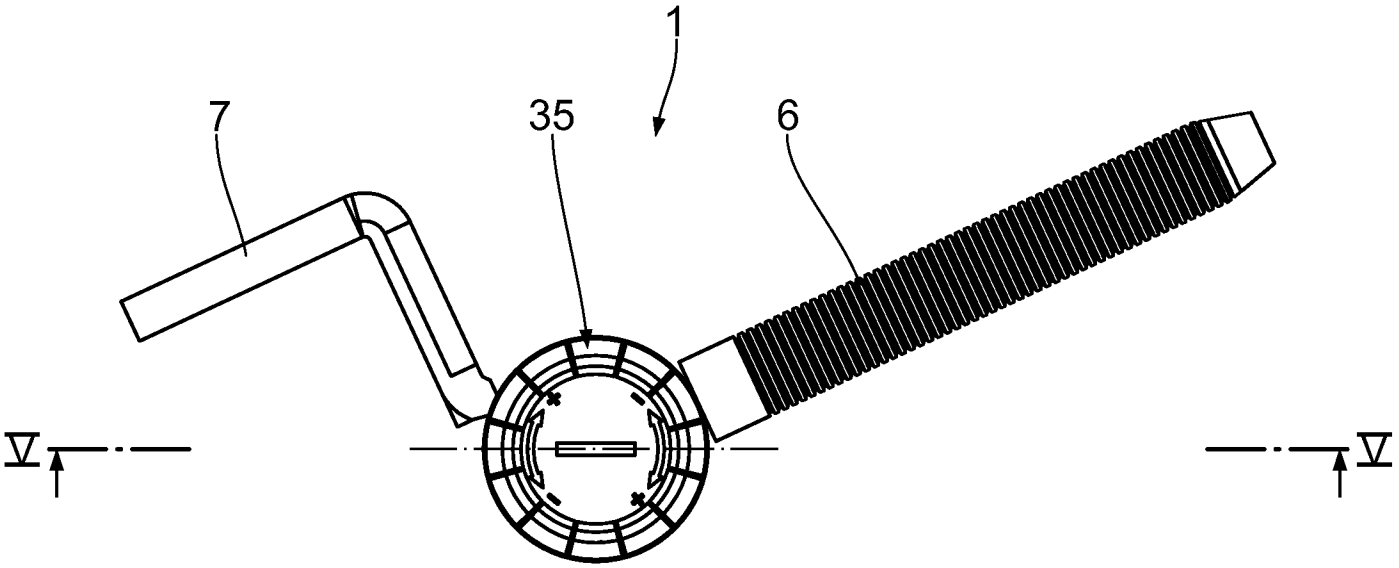
FIG. 4 shows a top view of the damping hinge according to FIG. 1.

A damping hinge 1 shown in FIGS. 1 to 10 has a housing 2 that extends along a hinge rotational axis 3. The function of the damping hinge 1 is to damp a hinge rotational movement about the hinge rotational axis 3. The housing has a two-part design, comprising a first housing part 4 and a second housing part 5, which is arranged relative to the first housing part 4 in such a way as to be rotatable about the hinge rotational axis 3. The housing 2 is substantially hollow cylindrical. An external diameter of the damping hinge 1 is substantially constant along the hinge rotational axis 3. The first housing part 4 is interrupted by the second housing part 5 along the hinge rotational axis 3. The first housing part 4 is arranged along the hinge rotational axis 3 on both sides of the second housing part 5. The second housing part 5 has mounting pins 6 extending radially in relation to the hinge rotational axis 3. The mounting pins 6 are used to connect the damping hinge 1 to a door frame. It is conceivable as well for the mounting pins 6 to be connected to a door leaf or any other pivotable part. The mounting pins 6 have a surface structure in the manner of grooves. The function of this surface structure is to improve the connection between the housing part 5 and the door frame, for example.

The first housing part 4 has an L-shaped angle element 7 that extends on an outer circumferential surface of the first housing part 4 along the hinge rotational axis 3. The angle element 7 allows the damping hinge 1 to be fastened to a door leaf. The angle element 7 is provided with through-holes allowing the first housing part 4 to be fastened to the door leaf. The function of the damping hinge 1 is in particular to damp a pivoting movement of a door leaf in relation to a door frame.

The design of the damping hinge 1 will now be explained in more detail with reference to FIGS. 2 to 7.

The housing 2 has a working chamber 8 filled with a fluid according to the exemplary embodiment as shown. The fluid used is for instance hydraulic oil. Other fluids, in particular gaseous and/or liquid fluids, are conceivable as well. The working chamber 8 is limited in the radial direction relative to the hinge rotational axis 3 by the housing 2 in the form of the first housing part 4. In the axial direction of the hinge rotational axis 3, the working chamber 8 is sealed by means of a sealing insert 9 and a protection cap 10. At an end of the working chamber 8 opposite to the sealing insert 9, the working chamber 8 is sealed by means of a working chamber seal 16. A piston 11 is arranged in the working chamber 8. The piston is displaceable in the working chamber 8 along the hinge rotational axis. The piston 11 is connected to a piston rod 12. The piston 11 is displaceable in the working chamber 8 along the hinge rotational axis 3. The piston 11 has a central borehole 19. The central borehole 19 is parallel to the hinge rotational axis 3.

The piston divides the working chamber 8 into a first partial working chamber 20 and a second partial working chamber 21. The first partial working chamber 20 is arranged between the sealing insert 9 and the lower side of the piston 11. The second partial working chamber 21 is arranged between the upper side of the piston 11 and the working chamber seal 16. Via the borehole 19, the first partial working chamber 20 is in fluid communication with the second partial working chamber 21. The piston rod 12 is configured in the manner of a sleeve. The piston rod 12 has a central borehole that extends along the hinge rotational axis 3. At an outer periphery, the piston rod 12 is provided with a piston rod external thread 13 that engages a corresponding sleeve internal thread 14 of a sleeve 15. The sleeve 15 is non-rotationally connected to the second housing part 5. When the second housing part 5 is rotated relative to the first housing part 4, this causes the sleeve 15 to rotate in relation to the piston rod 12, which is unable to rotate relative to the hinge rotational axis 3 but is displaceable axially in relation to the hinge rotational axis 3. As a result of this relative rotational movement, the piston rod 12 is displaced axially along the hinge rotational axis 3.

At an upper end of the piston rod 12, an axial sliding element 48 is provided. The axial sliding element 48 has a cross-sectional area perpendicular to the hinge rotational axis 3. The cross-sectional area has a non-round outer contour that may for instance be configured in the shape of a square, a hexagon or an octagon. It is conceivable as well for the axial sliding element 48 to have an oval outer contour. The axial sliding element 48 in particular has an outer contour that is complementary to an inner contour of the housing 2, in particular of the first housing part 4. The axial sliding element 48 is arranged in the housing 2 in such a way as to be non-rotational and axially displaceable in relation to the hinge rotational axis 3.

Figure 5:
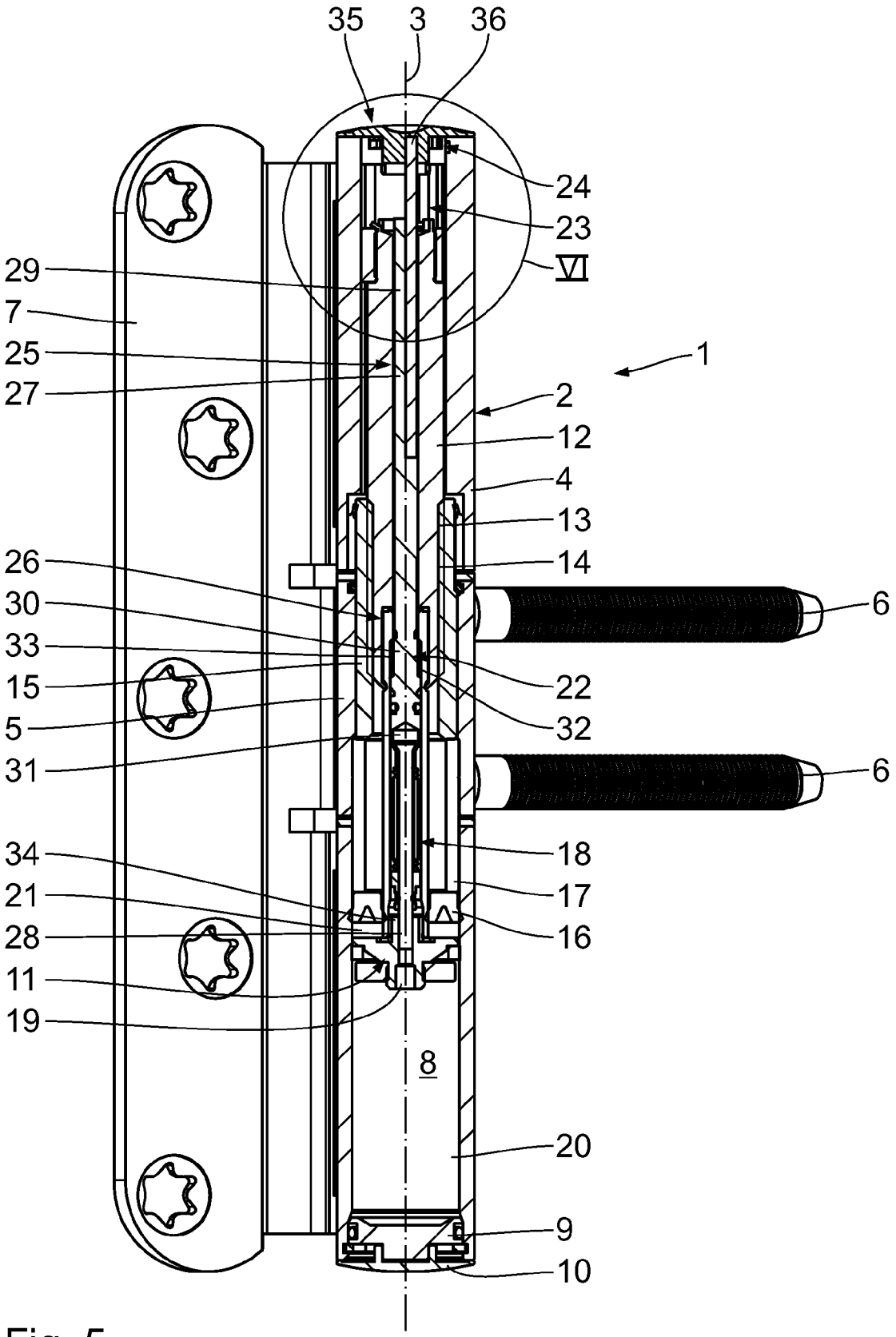
FIG. 5 shows a longitudinal sectional view along section line V-V in FIG. 4.
Figure 6:
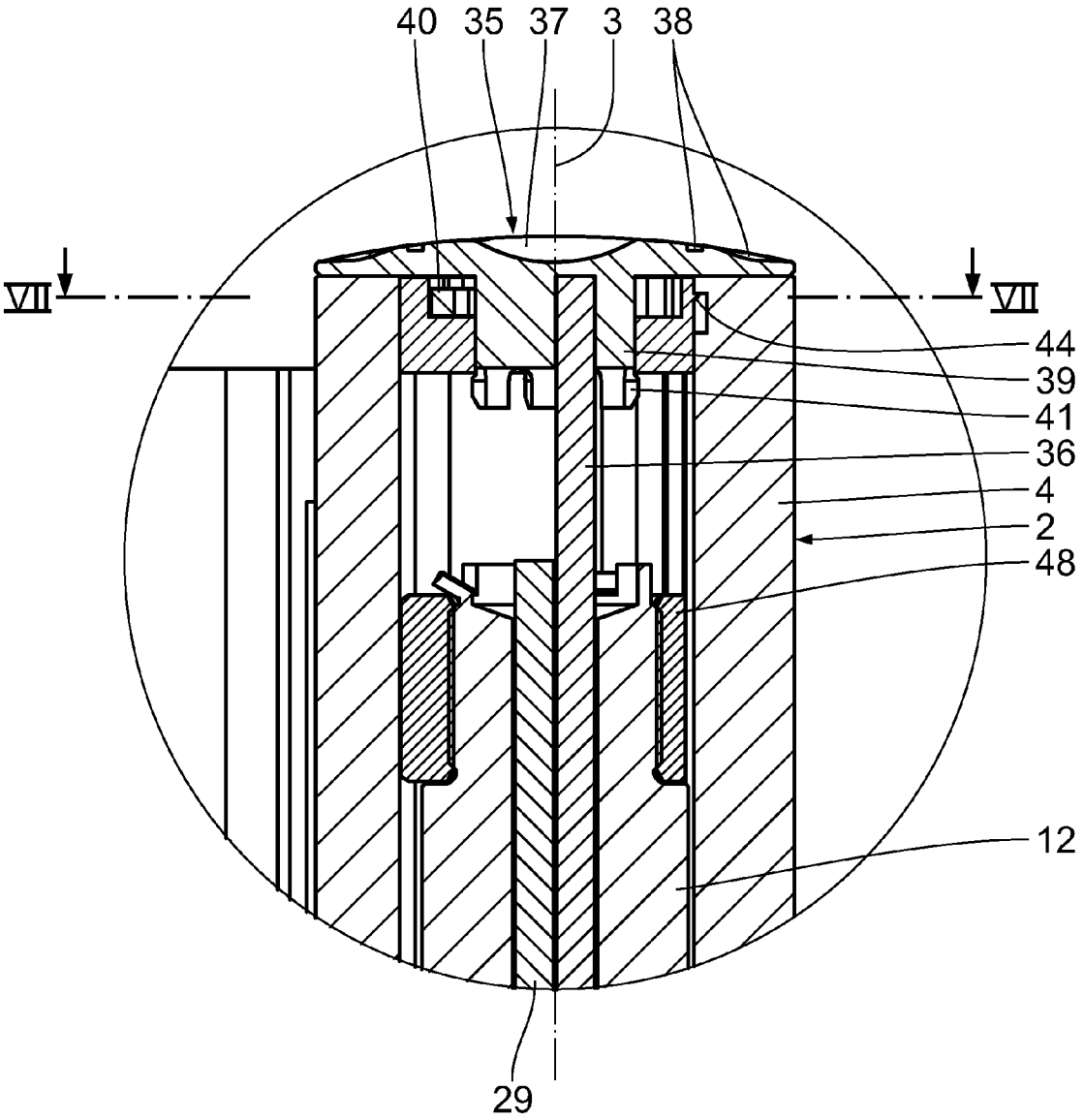
FIG. 6 shows an enlarged detail view of detail VI in FIG. 5.

In the arrangement shown in FIG. 5, the piston rod 12 and the piston 11 are in a topmost position. In this arrangement, the working chamber 8 is substantially arranged exclusively between the sealing insert 9 and a piston lower side facing the sealing insert 9.

Along the hinge rotational axis 3, a spacer 17 is provided between the working chamber seal 16 and the sleeve 15. The spacer 17 is configured in the manner of a sleeve.

Figure 7:
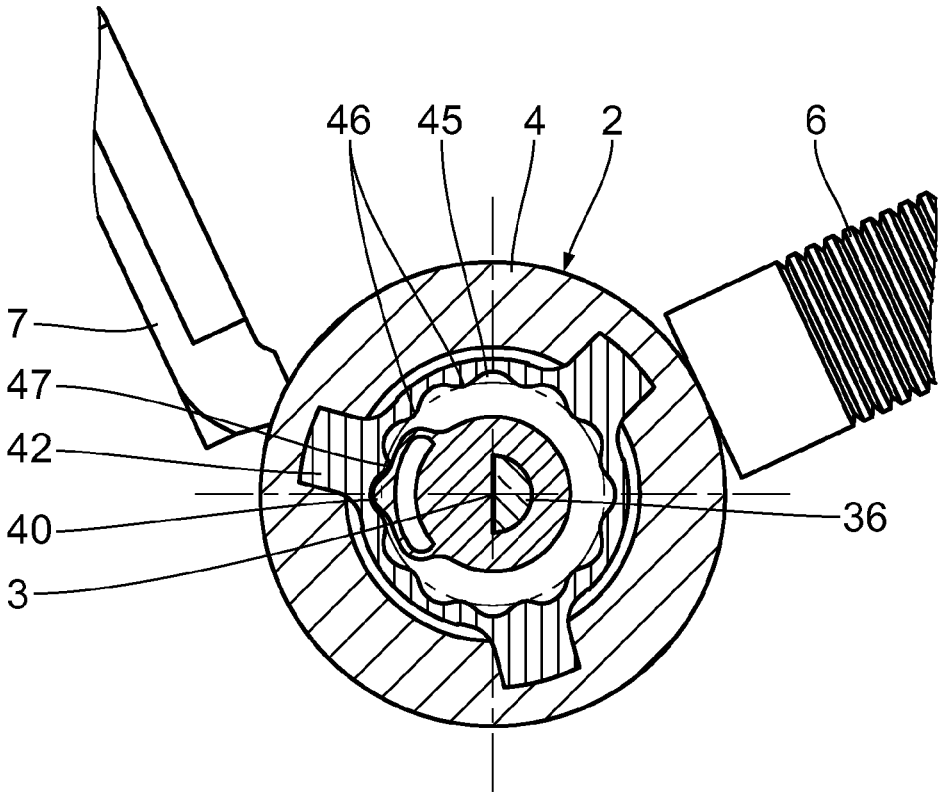
FIG. 7 shows a cross-sectional view along section line VII-VII in FIG. 6.
Figure 8:
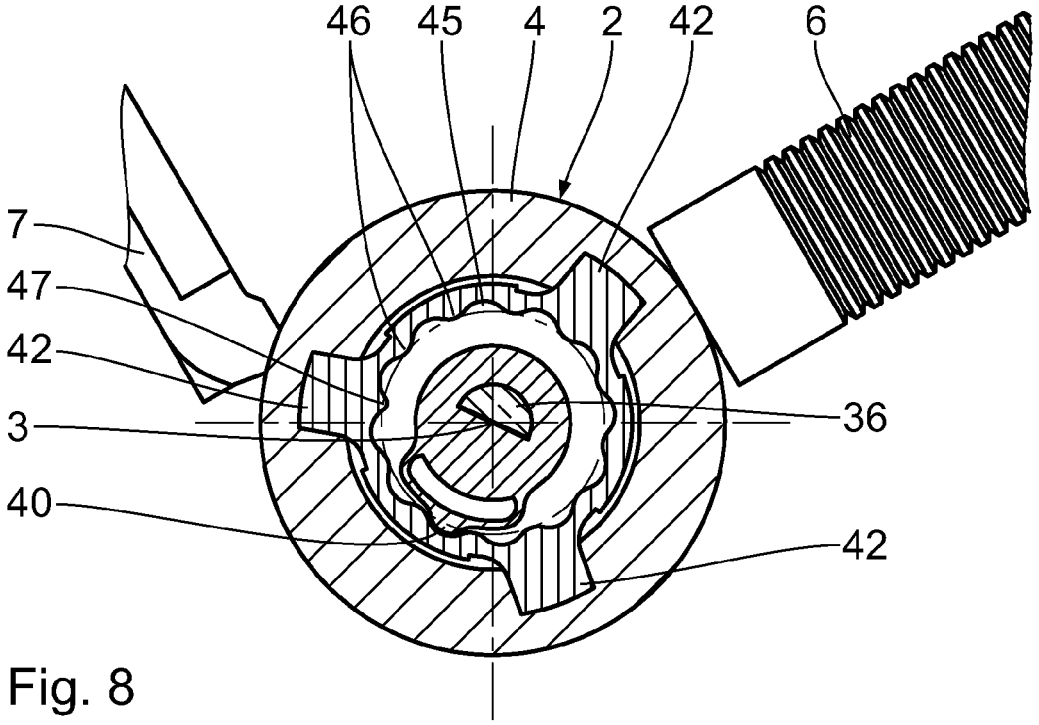
FIG. 8 shows a view, corresponding to FIG. 7, of the damping hinge in an adjustment stage different from that in FIG. 7.
Figure 9:
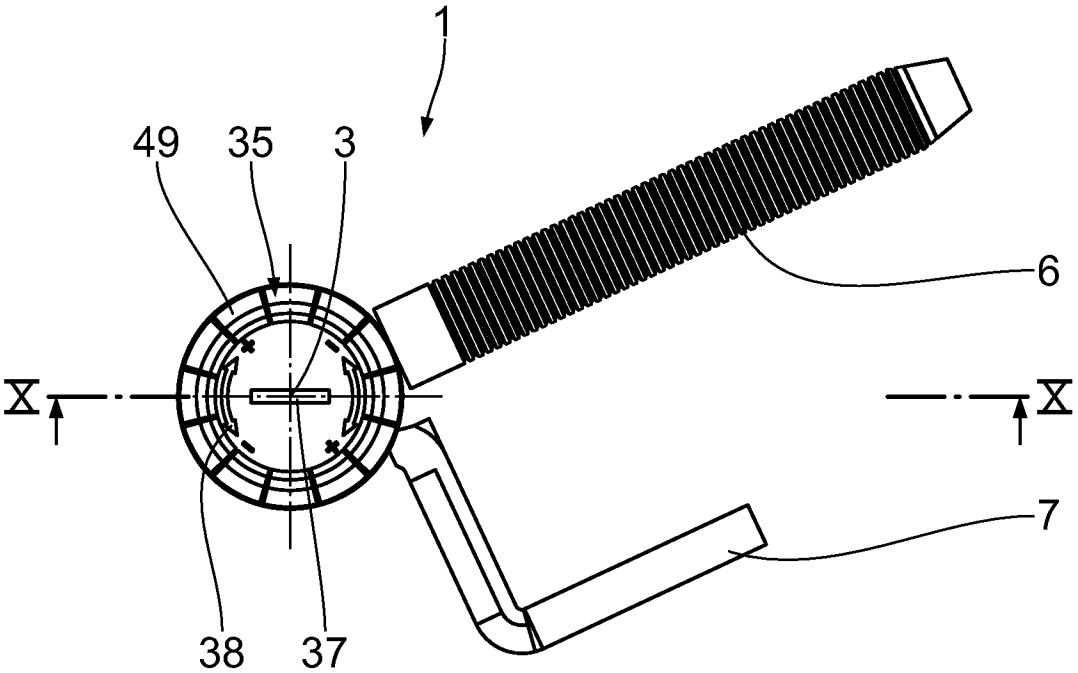
FIG. 9 shows a view, corresponding to FIG. 4, in an arrangement of the damping hinge following a rotational movement about the hinge rotational axis.
Figure 10:
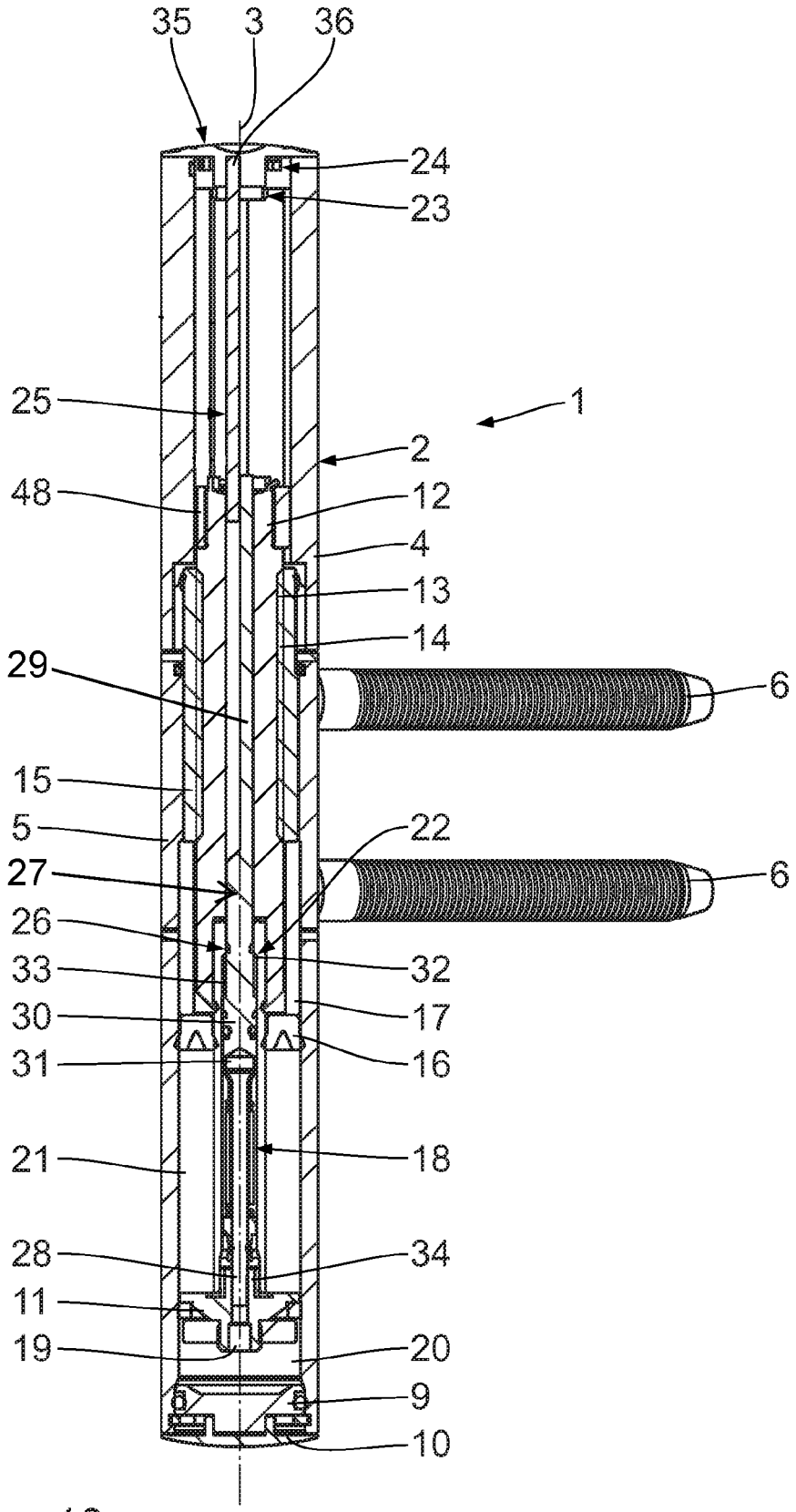
FIG. 10 shows a longitudinal sectional view along section line X-X in FIG. 9.

The damping hinge 1 has an adjustment device 18 for adjusting a damping effect of the damping hinge 1. The adjustment device 18 has a plurality of discrete adjustment stages each providing a different damping effect. Various adjustment stages for the damping hinge 1 are shown in FIGS. 7 and 8, which will be explained in more detail below. The damping effect corresponds to a damping constant of the damping hinge 1.

The adjustment device 18 comprises an adjustment unit 22, an actuation unit 23 to actuate the adjustment unit 22, and a snap-in locking unit allowing the actuation unit 23 to be arranged in a snap-locked manner.

The adjustment unit 22 will now be explained in more detail. The function of the adjustment unit 22 is to directly influence the damping effect of the damping hinge 1. The adjustment unit 22 has a first adjustment element 25 and a second adjustment element 26. The first adjustment element 25 is composed of multiple parts, comprising an adjustment spindle 27 and a needle 28 coupled with the adjustment spindle 27. The adjustment spindle 27 and the needle 28 are arranged one behind the other along the hinge rotational axis 3.

The first adjustment element 25 is arranged in the borehole of the piston rod 12. The adjustment spindle 27 has a first section 29. The first section 29 is remote from the piston 11. The first section 29 has a non-round cross-section in relation to the hinge rotational axis 3. The cross-sectional area of the first section 29 is configured in the shape of a semi-circle. A second section 30 is formed in one piece with the first section 29, the second section 30 facing the piston 11 and in particular the needle 28. At a lower end facing the needle 28, the second section 30 of the adjustment spindle 27 is partly hollow and provided with a receptacle 31. A head piece of the needle 28 is arranged and held axially in the receptacle 31.

At and end opposite to the head piece, the needle 28 is at least partly arranged in the borehole 19 of the piston 11. An external diameter of the needle 28 is smaller than an internal diameter of the borehole 19. In particular, the internal diameter of the borehole 19 amounts to at least 105%, in particular at least 110%, and in particular at least 120% of the external diameter of the needle 28. In this region, in other words where the needle 28 is arranged in the borehole 19, an in particular crescent-shaped cross-section is obtained along the passage opening, the cross-section having a reduced cross-sectional area. A fluid flow is throttled by the reduced cross-sectional area. This section of the borehole 19 forms a throttling channel. The throttling effect of the damping hinge 1 depends on the cross-sectional area of the annular surface, in other words the ratio of the internal diameter of the borehole 19 relative to the external diameter of the needle 28. The damping effect further depends on the length of the throttling channel along the hinge rotational axis 3. Therefore, the damping effect also depends on the insertion depth of the needle 28 in the borehole 19.

These parameters, in other words the ratio of the internal diameter of the borehole 19 to the external diameter of the needle 28 and the insertion depth of the needle 28 in the borehole 19, allow the damping effect of the damping hinge 1 to be influenced. The damping effect can be influenced directly via the insertion depth, in other words the relative positioning of piston 11 and needle 28 in relation to each other along the hinge rotational axis 3, without having to use another piston and/or another needle. It is conceivable for the needle 28 and/or the borehole 19 of the piston 11 to have a variable cross-section along the hinge rotational axis 3. A variable cross-section may for instance be obtained in such a way that the needle 28 and/or the borehole each have a circumferential surface in the shape of a truncated cone. An angle of inclination of the cone-shaped contour relative to the hinge rotational axis 3 may be different for the needle 28 and the borehole 19. In a configuration of this type, the axial relative movement between the needle 28 and the borehole 19 not only changes the insertion depth but in particular also the cross-sectional area of the annular cross-section.

The adjustment spindle 27 is co-rotatable with the needle 28 and arranged in the housing 2 in such a way as to be axially displaceable in relation to the hinge rotational axis 3. In particular, adjustment spindle 27 and needle 28 are axially displaceable in relation to the piston rod 12. At a lower end of the piston rod 12 facing the piston 11, an adjustment sleeve is fastened to the piston rod 12. The adjustment sleeve is the second adjustment element 26. The second adjustment element 26 is held on the piston rod 12 in the axial direction. A displacement of the piston rod 12 along the hinge rotational axis 3 results in an axial displacement of the second adjustment element 26. The second adjustment element 26 configured as the adjustment sleeve has an adjustment sleeve internal thread 32 that interacts with a corresponding adjustment spindle external thread 33. The adjustment spindle external thread 33 is in particular arranged in the second section 30 of the adjustment spindle 27. A rotational movement of the first adjustment element 25 about the hinge rotational axis 3 results in a longitudinal displacement of the first adjustment element 25 along the hinge rotational axis 3.

The second adjustment element 26 is fixed to the piston rod. A rotational movement of the adjustment unit 22, in particular the first adjustment element 25, causes the first adjustment element 25, in particular the needle 28, to be displaced relative to the piston rod 12 and to the piston 11. This allows the insertion depth of the needle 28 in the borehole 19 to be changed.

The second adjustment element 26 is used to connect the piston 11 to the piston rod 12. The second adjustment element 26 is configured in the manner of a sleeve and surrounds the adjustment spindle 27 and the needle 28 entirely. In order to connect the second adjustment element 26 to the piston 11, the piston 11 is provided, on an upper side facing the piston rod 12, with a connector 34 formed in one piece therewith, with the second adjustment element 26 being placed thereupon.

The adjustment spindle external thread 33 and the adjustment sleeve internal thread 32 form a movement thread. Via the movement thread, the first adjustment element 25 and the second adjustment element 26 are kinematically coupled in such a way that a rotation of the first adjustment element 25 about the hinge rotational axis 3 results in a displacement of the second adjustment element 26 along the hinge rotational axis 3 at the same time.

The actuation unit 23 will now be explained in more detail. The actuation unit 23 is used to actuate the adjustment unit 22. The actuation unit 23 comprises an actuation element 35 and a coupling element 36. The actuation element 35 and the coupling element 36 are non-rotationally coupled to each other in relation to the hinge rotational axis 3. The actuation element 35 is arranged on the housing 2 such as to be rotatable in relation to the hinge rotational axis 3. The actuation element 35 is substantially configured in the manner of a cap. The outer side of the actuation element 35 is provided with a tool section 37, a marking 38 and a grip section 49. The tool section 37 is configured in the manner of a slot. Width, length and depth of the slot are configured in such a way as to allow a coin, in particular a 1 cent coin, to be inserted therein. The coin may advantageously be used as a tool. The tool section 37 may also be configured as a cross recess or as a hexagon socket contour or a non-round socket contour. What is essential is that it is possible to apply a torque to the actuation element 35 relative to the hinge rotational axis 3 by applying a tool to the tool section 37.

The function of the marking 38 is to signalize to a user of the damping hinge 1 how to adjust a damping effect. A double arrow means that a rotational movement about the hinge rotational axis 3 is possible in both rotational directions. A "+" sign or a "−" sign, respectively, represents an increase or a reduction, respectively, of the damping effect, in other words an increase or a reduction, respectively, of the damping constant.

The grip section 49 has a circular recess extending along the outer periphery. The recess has a plurality of radial webs. The circular groove is interrupted by the radial webs. The grip section 49 allows the actuation element 35 to be actuated manually, in particular if a torque to be applied in order to adjust, in other words to rotate the actuation element 35, is not very high. Higher torques can be transmitted by applying the tool to the tool section 37.

A cylindrical shank 39 is formed in one piece with a lower side of the actuation element 35 facing the housing 2. A first snap-in locking element 40 in the form of a resilient snap-in locking protrusion is formed in one piece with an outer cylindrical surface of the shank 39. The first snap-in locking element 40 may be configured in multiple parts, and may in particular be produced as a separate component connected to the shank 39. At a lower free end of the shank 39, a connection element 41 in the form of a circumferential bead is provided. The function of the connection element 41 is to connect the actuation unit 23, in particular the actuation element 35, to the counter snap-in locking unit 24.

The coupling element 36 is formed on the lower side of the actuation element 35. In particular, the coupling element 36 is press-fitted and/or glued into a recess provided for this purpose. The coupling element 36 has a non-round cross-sectional area in relation to a plane oriented perpendicular relative to the hinge rotational axis 3. The cross-sectional area of the coupling element 36 is semi-circular.

In particular, the cross-sectional areas of the first section 29 of the adjustment spindle 27 and of the coupling element 36 are configured such as to complement each other in such a way that a total cross-sectional area has a round contour in relation to the hinge rotational axis 3. At the same time, the separation surfaces of adjustment spindle 27 and coupling element 36 are configured in such a way that when these separation surfaces abut against each other, a non-rotational connection or coupling is obtained in relation the hinge rotational axis 3.

The counter snap-in locking unit 24 will now be explained in more detail. The function of the counter snap-in locking unit 24 is to arrange the actuation unit 23 in a snap-locked manner. The counter snap-in locking unit 24 is configured in one piece. The counter snap-in locking unit 24 is made of plastics, in particular of polyoxymethylene (POM) or acrylonitrile butadiene styrene (ABS). The counter snap-in locking unit 24 is fixed to the housing. According to the illustrated exemplary embodiment, the counter snap-in locking unit 24 has three radially protruding anchor elements 42. According to the illustrated exemplary embodiment, the three anchor elements 42 are evenly distributed over an outer circumference of an annular section 43 of the counter snap-in locking unit 24. In relation to a circumferential angle of the hinge rotational axis 3, the anchor elements 3 are spaced from each other by an angle of 120°. The anchor elements 42 engage recesses of the housing 2 provided for this purpose. The anchor elements 42 ensure that the counter snap-in locking unit 24 is held in the housing 2 in such a way that it is unable to rotate therein. As an alternative or in addition thereto, the anchor elements 42 may be configured as so-called press hooks. The press hooks are in particular oversized with respect to the corresponding recesses in the housing 2. The counter snap-in locking unit 24 is press-fitted, with the press hooks, into the recesses provided for this purpose. As a result, a press fit is obtained between the counter snap-in locking unit and the housing.

The counter snap-in locking unit 24 is secured axially by locking elements 44. According to the illustrated exemplary embodiment, three locking elements 44 are provided, which are arranged along an outer circumference of the annular section 43 between two anchor elements 42. The locking elements 44 are configured as snap-in locking springs, which are fittable in a snap-locked manner into corresponding snap-in locking recesses provided on the housing. As far as the assembly of the damping hinge 1 is concerned, it is advantageous to preassemble the actuation unit, in particular the actuation element 35, with the counter snap-in locking unit 24. To this end, the shank 39 of the actuation element 35 is guided through a central opening of the counter snap-in locking unit 24. The connection element 41 is able to reach behind a front face of the counter snap-in locking unit 24, the front face being remote from the actuation element 35. Actuation element 35 and counter snap-in locking unit 24 are thus preassembled reliably and connected reliably and securely in the axial direction of the hinge rotational axis 3.

On an upper side facing the actuation element 35, the counter snap-in locking unit 24 is provided with twelve counter snap-in locking elements 45. The counter snap-in locking elements 45 are configured as snap-in locking grooves. The counter snap-in locking elements 45 are formed in such a way as to interact with the first snap-in locking element 40 of the actuation element 35 to allow a snap-locked arrangement of the actuation unit 35 on the housing 2. In particular, a convex outer contour of the first snap-in locking element 40 is configured such as be complementary to a respective concave inner contour of the snap-in locking grooves. It is conceivable as well to provide more or less than twelve counter snap-in locking elements 45. The snap-in locking grooves extend in the radial direction in relation to the hinge rotational axis 3. Two adjacent snap-in locking grooves are separated from each other by a rounded web 46.

Due to the flexible resilient structure of the first snap-in locking element 40, which ensures a flexibility in particular when actuated in the radial direction, in particular in the direction of the hinge rotational axis 3, the actuation element 35 is snap-lockable with one of the counter snap-in locking elements 45 in a variable position thereof by means of a rotational movement of the actuation element 35 about the hinge rotational axis 3. The flexibility of the first snap-in locking element 40 ensures an elastic deformation radially to the hinge rotational axis 3, said elastic deformation being required to overcome the web 46, in other words to move the first snap-in locking element 40 past the web 46.

At least one of the webs 46 is configured as a stop element 47. The stop element 47 differs from the webs 46 in terms of its radial dimensions. The stop element 47 penetrates deeper into the recess of the counter snap-in locking unit 24. This means that a free distance between the coupling element and the stop element 47 is reduced. Said reduced distance, which corresponds to a reduced effective internal diameter of the recess of the counter snap-in locking unit 24, has the effect that a rotational resistance required to further rotate the first snap-in locking element 40 of the actuation element 35 hitting the stop element 47 is greater than a rotational resistance for moving the actuation element 35 over one of the webs 46. According to the illustrated exemplary embodiment, precisely one stop element 47 is provided. When turning over the stop element 47, a user knows that a full 360° rotation was carried out. In particular if it is necessary to adjust the damping effect in such a way that a plurality of total rotations, in other words a rotational adjustment movement of more than 360° is required, the total angle of rotation covered can be determined more easily.

A function of the damping hinge 1, in particular the actuation thereof, will now be explained in more detail. Starting from a first arrangement shown in FIGS. 4 to 7, the housing parts 4, 5 are displaced relative to each other, in other words they are rotated about the hinge rotational axis 3 in relation to each other. The relative rotation of the first housing part 4 in relation to the second housing part 5 causes the piston rod 12 to be displaced along the hinge rotational axis 3 by the interaction of piston rod external thread 13 and sleeve internal thread 14. Starting from the topmost position, shown in FIG. 5, of the piston rod 12 and the piston connected thereto, piston rod 12 and piston 11 are displaced to a lowermost position according to FIG. 9. The piston rod 12 rotating about the hinge rotational axis 3 is guided for axial displacement along the inner contour of the housing 2 by means of the axial sliding element 48. The axial displacement of the piston 11 causes damping fluid to be displaced from the first partial working chamber 20 through the borehole 19 and the throttling channel formed therein, past the needle 28 and into the second partial working chamber 21, thus resulting in a damping effect on the hinge rotational movement.

The function of the adjustment device 18 will now be explained in more detail. Starting from the adjustment arrangement according to FIG. 5, the damping effect of the damping hinge 1 according to the invention can be changed in a defined manner by actuating the actuation element 35 of the actuation unit 23. An actuation takes place by rotating the actuation element 35 about the hinge rotational axis 3 in relation to the housing 2. A rotational movement of this type can be brought about by means of a tool not shown, the tool engaging the tool section 37, or manually by engaging the grip section 49. A manual actuation via the grip section 49 will preferably be carried out if the rotational movement is required to overcome a web 46. If it is necessary to turn over the stop element 47, thus requiring an increased torque, this will typically be done using the tool.

Owing to the marking 38, the user knows immediately in which direction a rotational movement of actuation needs to be carried out to increase or reduce a damping effect. The coupling element 36 is rotated depending on the rotational movement of the actuation element 35. The coupling element 36 is arranged eccentrically to the hinge rotational axis 3. The coupling element 36 interacts with the first section 29 of the adjustment spindle 27 in such a way that a rotational movement of the actuation element is transferred to the first adjustment element 25 via the coupling element 36. Owing to the movement thread, in other words the interaction of the adjustment sleeve internal thread 32 with the adjustment spindle external thread 33, a rotational movement of the first adjustment element 25 causes the first adjustment element 25 to be displaced axially along the hinge rotational axis 3. Said axial displacement of the adjustment element along the hinge rotational axis 3 causes the needle 28 to be displaced in relation to the piston 11 and the borehole 19 thereof, thus changing the penetration depth of the needle 28 into the borehole 19 and, consequently, the throttling effect, in other words the damping effect, of the damping hinge 1. Starting from a first adjustment arrangement in FIG. 7, the adjustment device 18 has been rotated in the counter-clockwise direction by two adjustment stages (cf. FIG. 8). As indicated by the marking, said rotational movement results in a reduced damping effect. The penetration depth of the needle 28 is reduced. Seen in the circumferential direction, the first snap-in locking element 40 of the actuation element 35 is arranged in the next but one snap-in locking groove when seen in the counter-clockwise direction.

When the damping hinge 1 is opened or closed, the actuation element 35, the coupling element 36 and the adjustment unit 22, and in particular the counter snap-in locking unit 24, are non-rotationally arranged in the housing 2. This means that the damping effect is not changed when the damping hinge 1 is opened or closed. An inadvertent adjustment of the damping effect is excluded. The adjustment device 18 can be rotated only when actuated by a user via the actuation unit 23. Due to the fact that the first snap-in locking element 40 of the actuation element 35 snap-locks with one of the counter snap-in locking elements 45, this allows a defined damping effect to be set. In particular, the adjustment device 18 has a plurality of discrete adjustment stages, which are in particular adjustable reproducibly.

What is claimed is:

1. A damping hinge for damping a hinge rotational movement about a hinge rotational axis, the damping hinge comprising:

a housing extending along the hinge rotational axis, the housing comprising a first housing part, a second housing part and a working chamber arranged in one of the first housing part and the second housing part, the second housing part being rotatable about the hinge rotational axis in relation to the first housing part;

a piston arranged in the working chamber such as to be displaceable along the hinge rotational axis, wherein the piston divides the working chamber into a first partial working chamber and a second partial working chamber, the piston further comprising a throttling channel, which produces a throttled fluid communication between the first partial working chamber and the second partial working chamber for damping displacement of the piston;

a piston rod for displacing the piston when rotating the first housing part and the second housing part about the hinge rotational axis relative to each other;

an adjustment device for adjusting a damping effect of the damping hinge by adjusting the fluid communication along the throttling channel, the adjustment device having a plurality of discrete adjustment stages each providing a different damping effect, wherein the adjustment stages are reproducibly adjustable.

2. The damping hinge according to claim 1, wherein the adjustment device has an adjustment unit for directly influencing the damping effect, wherein the adjustment unit comprises a first adjustment element and a second adjustment element.

3. The damping hinge according to claim 2, wherein the first adjustment element and the second adjustment element are kinematically coupled in such a way that a rotation of the first adjustment element about the hinge rotational axis results in a displacement of the second adjustment element along the hinge rotational axis at the same time.

4. The damping hinge according to claim 2, wherein the adjustment unit is at least partly arrangeable inside the throttling channel.

5. The damping hinge according to claim 4, wherein the first adjustment element is at least partly arrangeable inside the throttling channel.

6. A damping hinge for damping a hinge rotational movement about a hinge rotational axis, the damping hinge comprising:

a housing extending along the hinge rotational axis, the housing comprising a first housing part, a second housing part and a working chamber arranged in one of the first housing part and the second housing part, the second housing part being rotatable about the hinge rotational axis in relation to the first housing part;

a piston arranged in the working chamber such that the piston is displaceable along the hinge rotational axis, wherein the piston divides the working chamber into a first partial working chamber and a second partial working chamber, the piston further comprising a throttling channel, which produces a throttled fluid communication between the first partial working chamber and the second partial working chamber for damping displacement of the piston;

a piston rod for displacing the piston when rotating the first housing part and the second housing part about the hinge rotational axis relative to each other;

an adjustment device for adjusting a damping effect of the damping hinge by adjusting the fluid communication along the throttling channel, the adjustment device having a plurality of discrete adjustment stages, each of the discrete adjustment stages providing a different damping effect, wherein the adjustment device has an actuation unit for actuating an adjustment unit, wherein the actuation unit has an actuation element and a coupling element.

7. The damping hinge according to claim 6, wherein the actuation element and the coupling element are non-rotationally coupled to each other in relation to the hinge rotational axis.

8. The damping hinge according to claim 6, wherein the actuation element is arranged in the housing such as to be rotatable in relation to the hinge rotational axis.

9. The damping hinge according to claim 6, wherein the coupling element has a non-round cross-section oriented perpendicular to the hinge rotational axis.

10. A damping hinge for damping a hinge rotational movement about a hinged rotational axis, the damping hinge comprising:

a housing extending along the hinge rotational axis, the housing comprising a first housing part, a second housing part and a working chamber arranged in one of the first housing part and the second housing part, the second housing part being rotatable about the hinge rotational axis relative to the first housing part;

a piston arranged in the working chamber such that the piston is displaceable along the hinge rotational axis, wherein the piston divides the working chamber into a first partial working chamber and a second partial working chamber, the piston further comprising a throttling channel, which produces a throttled fluid communication between the first partial working chamber and the second partial working chamber for damping displacement of the piston;

a piston rod for displacing the piston when rotating the first housing part and the second housing part about the hinge rotational axis relative to each other;

an adjustment device for adjusting a damping effect of the damping hinge by adjusting the fluid communication along the throttling channel, the adjustment device having a plurality of discrete adjustment stages, each of the plurality of discrete adjustment stages providing a different damping effect, wherein the adjustment device has an actuation unit for actuating an adjustment unit, wherein the actuation unit has an actuation element and a coupling element, wherein the adjustment device has a counter snap-in locking unit allowing the actuation unit to be arranged at the counter snap-in locking unit in a snap-locked manner.

11. The damping hinge according to claim 10, wherein the counter snap-in locking unit is made in one piece.

12. The damping hinge according to claim 11, wherein the counter snap-in locking unit is made of plastics.

13. The damping hinge according to claim 11, wherein the counter snap-in locking unit is made of at least one of the group comprising polyoxymethylene (POM) and acrylonitrile butadiene styrene (ABS).

14. The damping hinge according to claim 10, wherein the counter snap-in locking unit is fixed to the housing.

15. The damping hinge according to claim 14, wherein the counter snap-in locking unit has at least one locking element allowing it to be locked to the housing.

16. The damping hinge according to claim 10, wherein the counter snap-in locking unit has a plurality of counter snap-in locking elements.

17. The damping hinge according to claim 10, wherein the actuation unit is connected to the counter snap-in locking unit by means of a connection element.

* * * * *